US009145648B2

(12) United States Patent
Crover

(10) Patent No.: US 9,145,648 B2
(45) Date of Patent: Sep. 29, 2015

(54) HYDRAULIC SPIKE PULLER

(75) Inventor: Stephen Crover, Damascus, OR (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 104 days.

(21) Appl. No.: 13/420,450

(22) Filed: Mar. 14, 2012

(65) Prior Publication Data

US 2013/0240806 A1 Sep. 19, 2013

(51) Int. Cl.

| | |
|---|---|
| ***B25C 11/00*** | (2006.01) |
| ***E01B 29/26*** | (2006.01) |
| *B25B 33/00* | (2006.01) |
| *B25B 9/00* | (2006.01) |
| *B25B 7/00* | (2006.01) |

(52) U.S. Cl.

CPC ..... *E01B 29/26* (2013.01); *B25C 11/00* (2013.01); *B25B 7/00* (2013.01); *B25B 9/00* (2013.01); *B25B 33/00* (2013.01); *Y10T 29/49822* (2015.01)

(58) Field of Classification Search

USPC ..... 254/18

See application file for complete search history.

(56) References Cited

U.S. PATENT DOCUMENTS

| | | | | |
|---|---|---|---|---|
| 2,639,887 | A | 5/1953 | Henry | |
| 2,706,103 | A | 4/1955 | Stambaugh et al. | |
| 2,797,889 | A | 7/1957 | Talboys | |
| 3,643,918 | A | 2/1972 | Ellis | |
| 3,746,306 | A * | 7/1973 | Ellis et al. | 254/19 |
| 3,819,153 | A * | 6/1974 | Hurst et al. | 254/93 R |
| 4,078,766 | A | 3/1978 | Saurwein | |
| 4,249,293 | A | 2/1981 | Schulberg | |
| 4,456,226 | A | 6/1984 | Stumpmeier | |
| 5,253,844 | A * | 10/1993 | Cotic et al. | 254/18 |
| 5,524,868 | A * | 6/1996 | Decker et al. | 254/93 H |
| 5,704,591 | A | 1/1998 | Byrne | |
| 5,924,679 | A * | 7/1999 | Wilson | 254/18 |
| 6,015,136 | A | 1/2000 | Benudiz | |
| 6,098,960 | A | 8/2000 | Lefavour et al. | |
| 6,113,073 | A * | 9/2000 | Lefavour et al. | 254/18 |
| 6,367,139 | B2 | 4/2002 | Wille | |

(Continued)

FOREIGN PATENT DOCUMENTS

| | | |
|---|---|---|
| EP | 1 366 864 A1 | 12/2003 |
| EP | 1 496 157 B1 | 8/2006 |

OTHER PUBLICATIONS

Geismar, Modern Track Machinery, *Model Sp-4 2 Stage Spike Puller*, product spec sheet, Nov. 2009, 1 page.

(Continued)

*Primary Examiner* — Lee D Wilson
*Assistant Examiner* — Alvin Grant
(74) *Attorney, Agent, or Firm* — Pillsbury Winthrop Shaw Pittman LLP

(57) ABSTRACT

A pulling tool includes a housing and a tube disposed within the housing, the tube configured to supply hydraulic fluid. The spike puller further includes a piston rod connected to a piston. The piston rod has a hollow axial bore, and the piston and the piston rod are axially moveable relative to the tube. The spike puller has a passage communicating fluid from the tube to the piston. The passage is contained within the housing. The passage is variable between a first configuration in which hydraulic fluid flows at a first restricted flow so as to provide a slower retraction of the piston rod and a second configuration in which hydraulic fluid flows at a second less restricted flow so as to provide a faster retraction of the piston rod.

33 Claims, 11 Drawing Sheets

(56) References Cited

U.S. PATENT DOCUMENTS

| | | | | |
|---|---|---|---|---|
| 6,532,635 | B1 | 3/2003 | Gregory | |
| 6,598,856 | B1 * | 7/2003 | Puff et al. | 254/18 |
| 6,622,361 | B1 * | 9/2003 | Wilson | 29/229 |
| 6,935,620 | B1 * | 8/2005 | Wilson | 254/18 |
| 7,076,851 | B2 | 7/2006 | Rousset | |
| 8,375,544 | B1 * | 2/2013 | Wilson | 29/243.56 |

OTHER PUBLICATIONS

Geismar, Modern Track Machinery, *Hydraulic Spike Puller Model MTM-SP4*, Operators Manual/Parts List, Mar. 2009, 18 pages.

* cited by examiner

HYDRAULIC SPIKE PULLER

BACKGROUND OF THE INVENTION

1. Field of the Invention

The present invention pertains to hydraulic spike pullers or pulling tools.

2. Discussion of Related Art

Spike pullers are devices used to remove rail fasteners commonly called rail spikes. Currently, there exist numerous spike pullers in the market. In the present description, the term "spike puller" refers to a device that is capable of removing, extracting or pulling a rail spike.

FIG. 1 shows a cross-sectional view of a conventional hydraulic spike puller 10 manufactured by Stanley Black and Decker, commonly referred to as Stanley Hydraulic Tool (SHT). SHT 10 has an upper body portion 11A and a lower body portion 11B. The upper portion 11A includes a housing (e.g., cylinder) 12. The cylinder 12 includes a tubular portion 13 capped by head portion 12A and bottom portion 12B. SHT 10 also includes piston 14 configured to axially move within the cylinder 12. Fixed to the underside of piston 14 is piston rod 16. A first end 16A of piston rod 16 is connected to piston 14. A second end 16B of piston rod 16 is connected to spike puller jaw assembly 18 which includes articulated jaws 18A and 18B. Piston rod 16 has a hollow axial bore 17 extending along most of a length of piston rod 16. Piston rod 16 is axially slideable within lower body portion 11B.

SHT 10 further includes fixed hollow tube 20. Fixed hollow tube 20 is connected to cylinder head 12A and extends axially from the cylinder head 12A through piston 14 into piston rod 16. Fixed hollow tube 20 extends the length of cylinder 13 into hollow axial bore 17 of piston rod 16. The external diameter of fixed hollow tube 20 is smaller than the internal diameter of hollow axial bore 17.

SHT 10 further includes hydraulic valve assembly 22 disposed adjacent cylinder head 12A. Hydraulic valve assembly 22 is configured to be manually operated by trigger 24 to direct hydraulic fluid pressure either to the top 14A of the piston 14 so as to extend the piston rod 16 or to the underside 14B of piston 14 so as to retract the piston rod 16 and pull the spike (not shown) using spike puller jaw assembly 18.

In operation, when raising the piston to pull a spike, the valve assembly 22 directs hydraulic fluid down through the axial fixed hollow tube 20 so as to direct hydraulic fluid to the underside 14B of the piston 14. The hydraulic fluid exits the open end of the fixed hollow tube 20, and fills and pressurizes bore 17 of piston rod 16. The hydraulic fluid moves axially upward through a space between an external surface (external diameter) of the fixed hollow tube 20 and an internal surface (internal diameter) of the bore 17.

At a position proximate to the underside 14B of piston 14, the piston rod 16 includes a number of radial ports 26 extending through a wall of the piston rod 16. The oil moves radially outward through the ports 26 and underneath the piston 14, causing the piston 14 to rise upward within cylinder 12.

As will be explained in the following paragraphs, it is desirable to raise piston 14, i.e., raise or retract piston rod 16, at a first slower speed and then, after it has moved a first axial distance, to continue raising or retracting piston 14 and piston rod 16 at a second faster speed. In SHT 10, this is performed manually, by manually actuating trigger 24 to actuate hydraulic valve assembly 22 to a first position and then to a second position.

In the first position, only part of the hydraulic fluid and pressure is directed axially down the fixed tube 20, while another part of the hydraulic fluid pressure is bled off via a relief valve 28 back to the hydraulic return line (not shown). The reduced flow or partial pressure of the hydraulic fluid, generated when the valve assembly 22 is at the first position, yields the first slower rise or retraction speed of piston 14 or piston rod 16.

In the second position, the relief valve 28 is blocked and no bleeding of hydraulic fluid flow or hydraulic fluid pressure occurs. As a result, full hydraulic pressure and hydraulic flow are directed down the fixed tube 20 to the underside of piston 14B which yields the second faster rise or retraction speed of piston 14 and piston rod 16.

Hence, the rise or retraction of piston 14 or piston rod 16 is performed in two stages, a first slower speed stage and a second faster speed stage. As the piston rod 16 retracts, the jaws 18A and 18B in jaw assembly 18 pivot and grip or clamp the head of the spike or workpiece (not shown) to be pulled. This clamping or gripping clamping action tends to seat or pull the SHT 10 into axially alignment with the spike (not shown). In some instances, it may be desired to have an initial movement of clamping and aligning of the SHT 10 at a slower speed. Once the spike is clamped by the jaws 18A and 18B of jaw assembly 18 and SHT 10 has self-aligned, the user may then be able to pull the spike quickly with a second faster raising of piston 14 and piston rod 16.

Even though conventional SHT 10 provides dual stage or dual retraction speed of the piston 14 and piston rod 16, the operation of controlling the speed of retraction of piston 14 and piston rod 16 to achieve the dual retraction speed is performed manually by controlling the operation of the head valve 22 using trigger 24. Hence, it is desirable to provide for automatic two step or dual speed operation of the pulling or retracting process.

FIG. 2 is a cross-sectional view of another conventional spike puller 30. Spike puller 30 is manufactured by Geismar Corporation, France. Spike puller 30 also operates in a dual retraction speed mode. Spike puller 30 achieves the dual retraction speed automatically. Spike puller 30 includes a piston rod 32, a piston 34 connected to the piston rod 32, and a cylinder 36 housing both the piston rod 32 and piston 34. Hydraulic fluid (oil) is directed to underside 34A of piston 34 via oil line 38 located external to the cylinder 36. External oil line 38 has two branches 38A and 38B that enter the cylinder 36 via an upper radial port 36A and a lower radial port 36B, respectively. Lower radial port 36B is located below the piston 34 when the piston is in its start position. Upper radial port 36A is located at a height corresponding to the predetermined height at which it is desired to transition to high speed retraction.

Until the piston 34 rises above the level of port 36A, radial port 36A which is connected oil line 38A is blocked and oil flows to the underside 34A of piston 34 only via lower port 36B which is connected to oil line 38B. Lower port 36B has a check valve 39. Check valve 39 admits oil at restricted speed and pressure via its orifice 39A during retraction of piston 34. However, when the piston 34 rises above the position of port 36A, full oil flow and pressure is provided via oil line 38A to the underside 34A of piston 34. As a result, piston 34 continues to rise, but at a second faster speed. Thus, the spike puller 30 provides automatic transition from slow initial or first retraction to faster later or second retraction after a predetermined movement of the piston 34.

Similarly, during lowering or resetting of the spike puller 30, the underside of the piston 34A is initially vented via port 36A connected to oil line 38A, and descent of the piston 34 is relatively fast. However, when the descending piston 34 reaches the position of port 36B, piston 34 blocks port 36B. As a result, the pressure for evacuating oil through port 36B, oil line 38B and through check valve 39 increases. The increased oil pressure unseats check valve 39 and moves check valve 39 away from the external oil line 38. Hence, the speed of descent is maintained relatively fast during the lowering or resetting of piston 34.

Although spike puller 30 achieves the dual retraction speed automatically, the dual retraction speed is achieved by the use of external line 38 and check valve 39 which adds complexity to the overall spike puller 30. In addition, the use of external line 38 and check valve 39 may render the spike puller 30 vulnerable to damage.

As it can be appreciated from the above paragraphs, conventional spike pullers have certain drawbacks and limitations. A spike puller according to various embodiments of the invention, as described in the following paragraphs, circumvents the drawbacks of conventional spike pullers.

BRIEF SUMMARY OF THE INVENTION

An aspect of the present invention is to provide a pulling tool, such as for example a spike puller, including a housing and a tube disposed within the housing, the tube configured to supply hydraulic fluid. The spike puller further includes a piston rod connected to a piston. The piston rod has a hollow axial bore, and the piston and the piston rod are axially moveable relative to the tube. The spike puller has a passage communicating fluid from the tube to the piston. The passage is contained within the housing. The passage is variable between a first configuration in which hydraulic fluid flows at a first restricted flow so as to provide a slower retraction of the piston rod and a second configuration in which hydraulic fluid flows at a second less restricted flow so as to provide a faster retraction of the piston rod.

Another aspect of the present invention is to provide a method of pulling a workpiece, such as for example, a spike, a fastener, etc., with a dual-stage retraction pulling tool, the pulling tool including a housing, a piston and a piston rod. The method includes flowing hydraulic fluid through a relatively smaller first area within the housing so as to provide a slower movement of the piston and a slower retraction of the pulling tool. The method also includes automatically changing an area through which the hydraulic fluid flows from the first area to a second area larger than the first area. The method further includes flowing the hydraulic fluid through the relatively larger second area within the housing so as to provide a faster movement of the piston and a faster retraction of the pulling tool.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF EMBODIMENTS OF THE INVENTION

Figure 1:
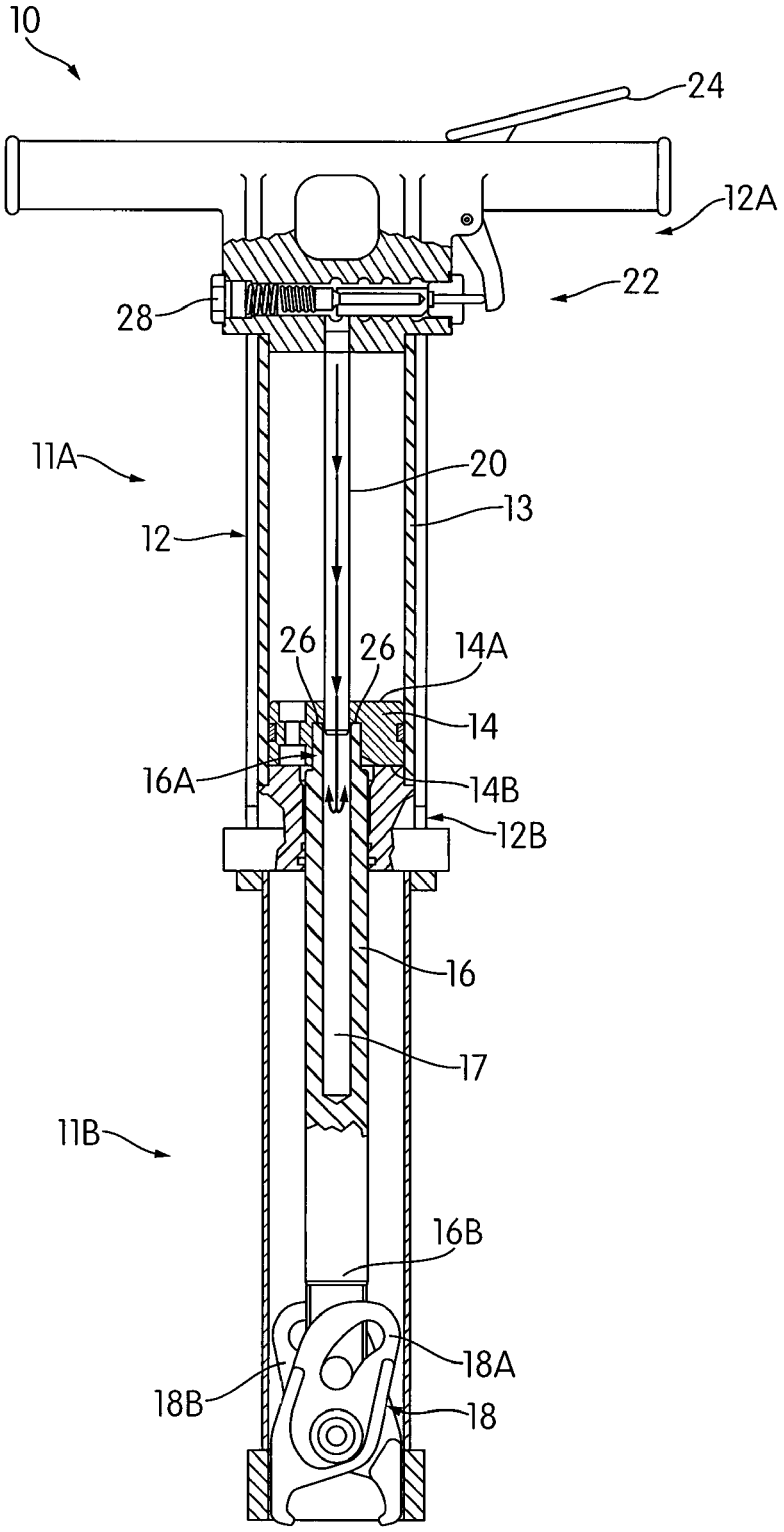
FIG. 1 (PRIOR ART)
FIG. 1 is a cross-sectional view of a conventional hydraulic spike puller manufactured by Stanley Black and Decker.
Figure 2:
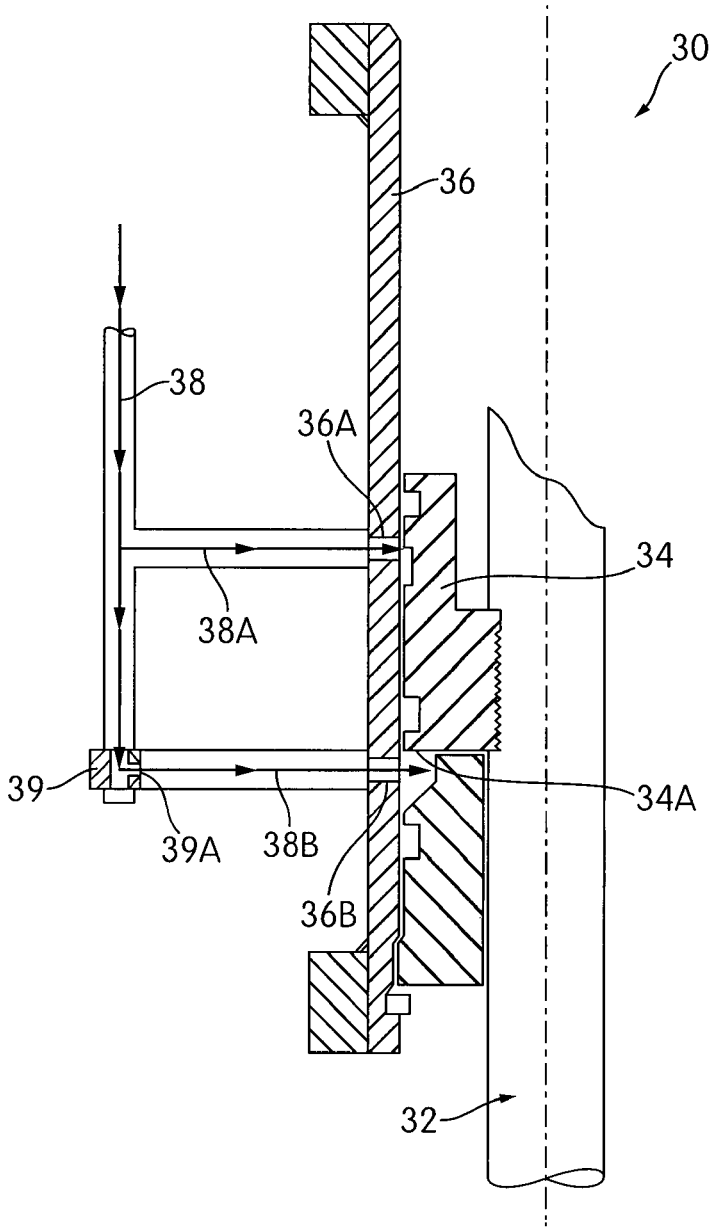
FIG. 2 (PRIOR ART)
FIG. 2 is a cross-sectional view of another conventional spike puller manufactured by Geismar.
Figure 3:
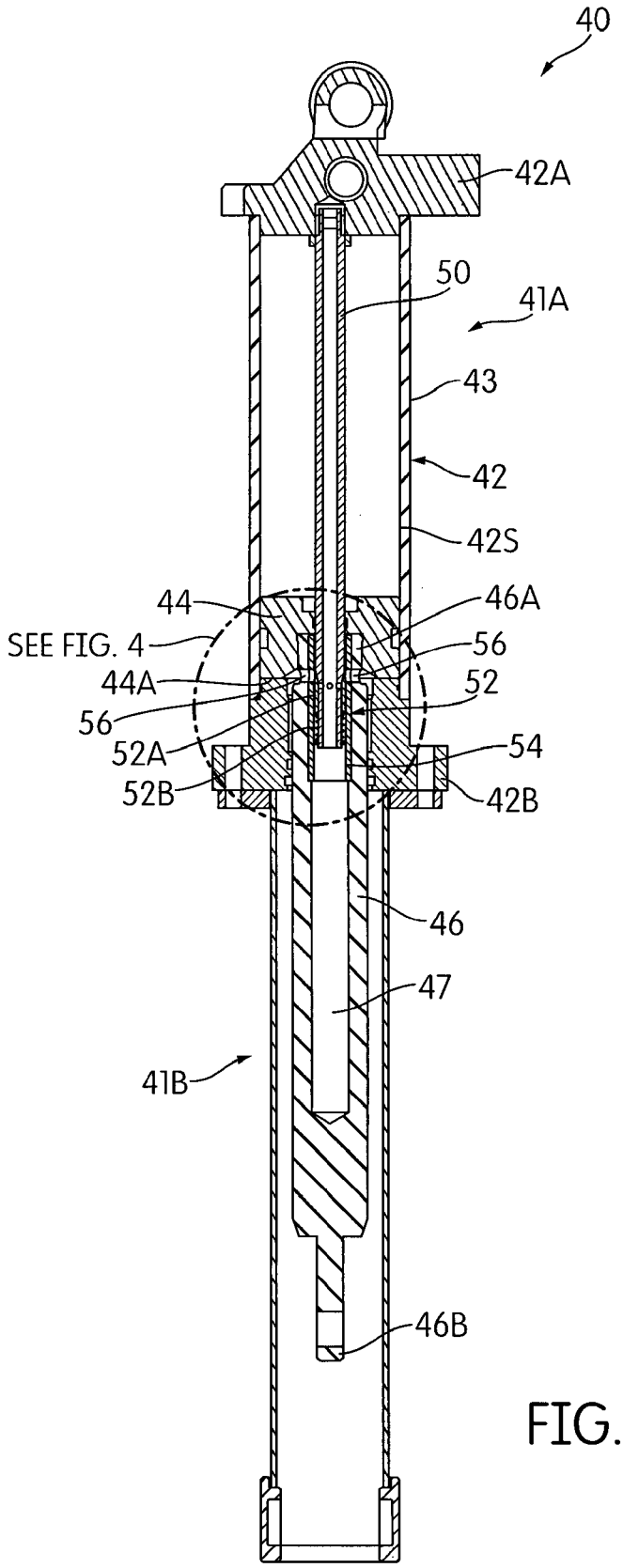
FIG. 3 is a cross-sectional view of a hydraulic spike puller, according to an embodiment of the present invention.

FIG. 3 is a cross-sectional view of a hydraulic spike puller 40, according to an embodiment of the present invention. Spike puller 40 has an upper body portion 41A and a lower body portion 41B. The upper body portion 41A includes a housing (e.g., cylinder) 42. The cylinder 42 includes a tubular portion 43 capped by head portion 42A and bottom portion 42B. Spike puller 40 also includes piston 44 configured to axially move within the cylinder 42. Fixed to piston 44 is piston rod 46. A first end 46A of piston rod 46 is connected to piston 44. A second end 46B of piston rod 46 is connected to a spike puller jaw assembly (not shown). Any type of spike puller jaw assembly can be connected piston rod 46. For example, a spike puller jaw assembly similar to jaw assembly 18 can be used. Piston rod 46 has a hollow axial bore 47 extending along most of a length of piston rod 46. Piston rod 46 is axially slideable within lower portion 41B.

Spike puller 40 further includes fixed hollow tube 50. Fixed hollow tube 50 is connected to cylinder head 42A and extends axially from the cylinder head 42A through piston 44 into piston rod 46. Fixed hollow tube 50 extends the length of cylinder 42 into hollow axial bore 47 of piston rod 46. The external diameter of fixed hollow tube 50 is smaller than the internal diameter of hollow axial bore 47 of piston rod 46.

Figure 4:
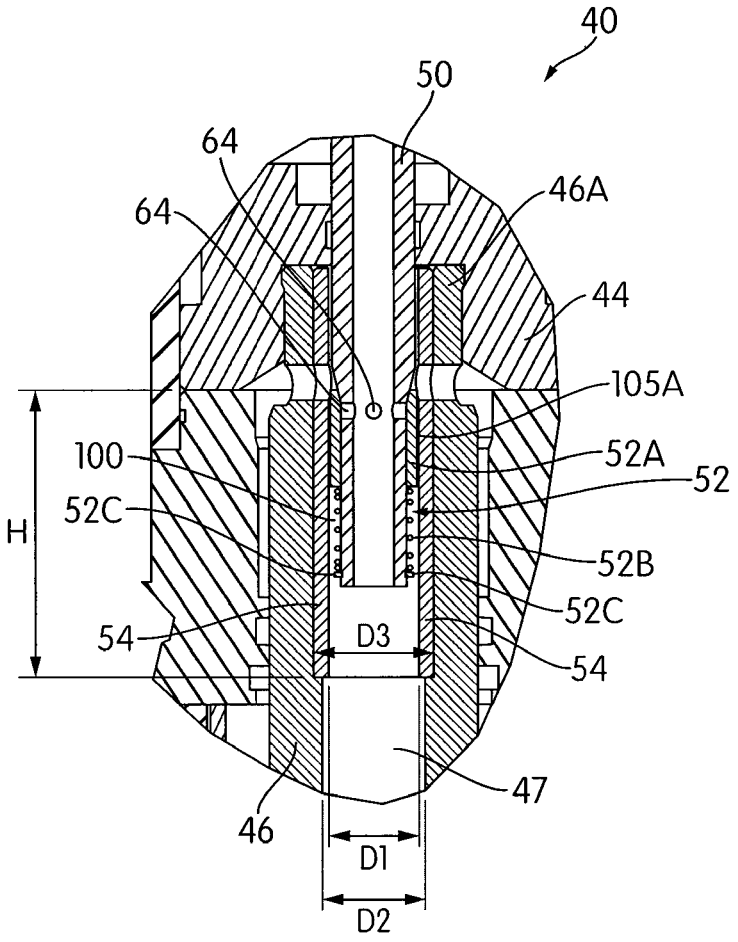
FIG. 4 is an enlarged cross-sectional view of the spike puller shown in FIG. 3, which shows a configuration of the spike puller during a first phase or reduced speed retraction of the spike puller.
Figure 5:
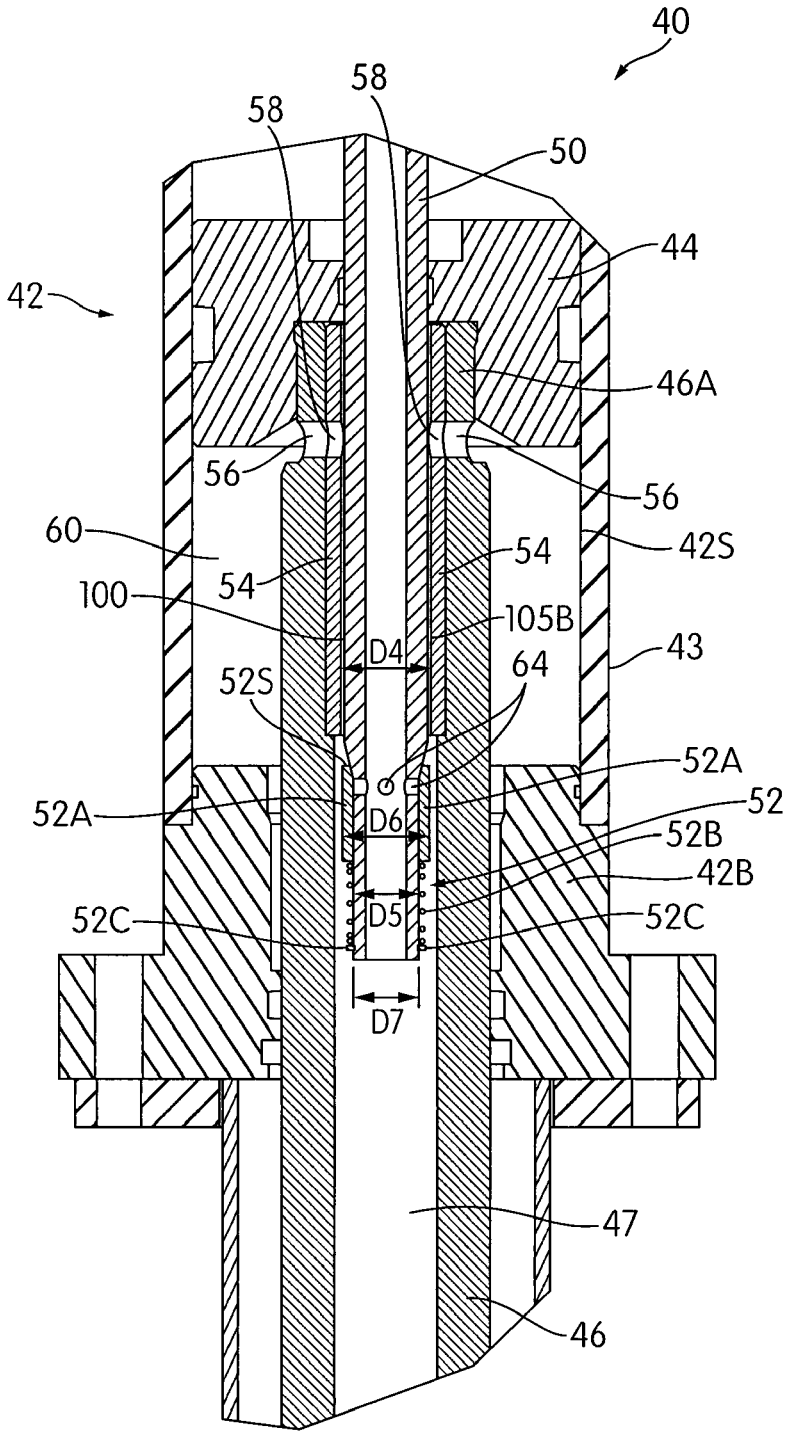
FIG. 5 is an enlarged cross-sectional view of the spike puller shown in FIG. 3, which shows a configuration of the spike puller during the second phase or full speed retraction of the spike puller.

FIGS. 4 and 5 are enlarged cross-sectional views of spike puller 40 shown in FIG. 3. As shown in FIGS. 4 and 5, spike puller 40 further includes a check valve 52. Check valve 52 includes sleeve member 52A and biasing member 52B disposed around a lower end portion of fixed hollow tube 50. Biasing member 52B (for example, a spring) abuts against a ledge 52C provided at a lower end of hollow tube 50. Biasing member (for example, a spring) 52B is adapted to bias the sleeve member 52A upwardly. Spike puller 40 also includes a liner 54 disposed at an upper portion of piston rod 46 and in contact within an internal surface of hollow axial bore 47 of piston rod 46. Piston rod 46 has radial ports or openings 56. Liner 54 has also openings or ports 58. The openings 56 and openings 58 are connected so as to allow hydraulic fluid to pass from the bore 47 of piston rod 46 actuate the piston 44. For example, as shown in FIG. 5, the openings 56, 58 are aligned to allow the hydraulic fluid to pass to a volume 60 between the piston rod 46 and tubular portion 43 and between bottom portion 42B of cylinder 42 and piston 44. In one embodiment, the hydraulic fluid can be, for example, oil. However, other hydraulic fluid with an appropriate viscosity can also be used.

The check valve sleeve 52A forms a hydraulic fluid flow control device for hydraulic fluid moving to and from the underside 44A of the piston 44. In one embodiment, the fixed hollow tube 50, the piston rod 46, the sleeve member 52A, and the liner 54 may have a cylindrical shape. However, as it can be appreciated, in other embodiments, the fixed hollow tube 50, the piston rod 46, the sleeve member 52A, and the liner 54 may have other shapes with a polygonal transversal cross-section shape (e.g., square, hexagonal, etc.).

In one embodiment, the liner 54 has an internal diameter D1 and an external diameter D3, the hollow axial bore 47 of piston rod 46 has a diameter D2. The diameter D1 is less than the diameter D2. In one embodiment, as shown for example in FIG. 4, the diameter D3 is greater than both diameter D1 and diameter D2. In one embodiment, as shown for example in FIG. 5, the fixed hollow tube 50 has stepped configuration and has an external diameter D4 at its thicker portion and diameter D7 at its narrower portion. However, in other embodiments, the fixed hollow tube 50 may have other configurations, such as, for example, a tapered configuration or a combination of a stepped-tapered configuration, or the like. Diameter D4 is smaller than diameter D1 and diameter D2. The sleeve member 52A has an internal diameter D5 and an external diameter D6. Diameter D5 is substantially equal to external diameter D7 of lower narrower portion of fixed hollow tube 50.

In operation, hydraulic fluid flows through fixed hollow tube 50 and fills and pressurizes the bore 47 of piston rod 46. The hydraulic fluid then flows back through an annular space between the external surface (with external diameter D4) of fixed hollow tube 50 and the internal surface (with internal diameter D3) of piston rod 46 and through a space between an external surface of fixed hollow tube 50 and an internal surface of sleeve 54 until it moves radially outward though ports 56 provided at upper portion 46A of piston rod 46 and ports 58 provided in liner 54. As a result, the pressure and flow of the hydraulic fluid ports reaches the underside 44A of piston 44 and acts upon piston 44 to lift the piston 44.

FIG. 4 shows a configuration of the spike puller 40 during a first phase or reduced speed retraction of piston rod 46 of spike puller 40. FIG. 5 shows a configuration of the spike puller 40 during the second phase or full speed retraction of piston rod 46 of spike puller 40. The second phase (full speed retraction) occurs automatically after the piston 44 has moved a predetermined amount.

As shown in FIG. 4, during the first phase (reduced speed retraction), sleeve 52A is concentric with the liner 54 and the annular space Δ1 between sleeve 52A and liner 54 is substantially equal to diameter D1 minus diameter D6 (Δ1=D1−D6).

As shown in FIG. 5, after a predetermined movement of piston 44, liner 54 is pulled upward past and away from the check valve sleeve 52A. As a result, the annular passage Δ2 for hydraulic fluid becomes larger and greater than Δ1. The annular passage Δ2 is substantially equal to diameter D1 minus diameter D4 (Δ2=D1−D4). Indeed, since diameter D4 is smaller than diameter D6, annular space Δ2 is greater than annular space Δ1. A larger annular passage (Δ2>Δ1) allows a less restricted flow and thus a greater follow of hydraulic fluid which results in a faster movement of the piston 44 during the second phase of retraction.

Therefore, spike puller 40 is configured to automatically speed up in retract mode after a certain predetermined amount of piston travel. The predetermined amount of travel is controlled by the distance H between a lower edge of liner 54 and port 56, 58 and/or controlled by the annular space between the external surface of the tube 50 and the internal surface of the liner 54. As a result, a longer distance H (i.e., a longer low portion of liner 54) and/or a thinner annular space Δ1 between the external surface of the tube 50 and internal surface of liner 54 provides a longer time period for accomplishing the first slower retraction phase. Hence, the distance H and/or the annular space Δ1 can be selected accordingly to tailor the first retraction phase.

In the operation of resetting the spike puller 40 and extending the piston rod 46, there is no alignment required. Therefore, resetting can be performed at a faster speed. Extending or resetting the spike puller, i.e., extending the piston rod 46, is achieved by directing hydraulic fluid flow or fluid pressure to the top of the piston 44 by using valve assembly (not shown) provided at end cap 42A. The speed of descent of the piston 44 is limited by the rate at which the hydraulic fluid underneath the piston 44 can be vented via hydraulic return lines (not shown).

As shown in FIGS. 3, 4 and 5, the hydraulic fluid is vented from underneath the descending piston 44 by flowing backward through essentially the same path it flowed inward during the retraction phase as described above. When piston 44 is high in cylinder 42, and the check valve 52 is below the liner 54, the speed limiting annular space is Δ2, which permits a faster movement of the piston 44. As the piston 44 nears the bottom of the cylinder 42, the liner 54 slides down over the check valve 11. Hence, the speed limiting annular space becomes smaller and equal to Δ1 (where Δ1<Δ2). As a result, the flow of hydraulic fluid is reduced which slows the movement of the piston 44 as it descends. However, because hydraulic pressure remains applied to the top of the piston 44, there is a corresponding increase in the pressure of oil vented under the piston. The higher venting hydraulic pressure acts on upper annular surface 52S of sleeve 52A of check valve 52 and pushes the sleeve 52A downwardly against the biasing force of resilient member (e.g., spring) 52B and axially moves the sleeve 52A relative to the tube 50. The downward axial movement of the sleeve 52A uncovers radial ports 64, which are provided within a lower part of the tube 50, opening an additional flow pathway for the hydraulic fluid to vent from the hollow axial bore 47 of piston rod 46 into tube 50. The vented hydraulic fluid into tube 50 is then sent back to the hydraulic return. Therefore, the opening of check valve 52 allows to maintain a relatively fast descent of the piston 44 to the lower start or reset position.

Although, in the above embodiments, the spike puller 40 is described comprising a check valve 52 and a liner 54, in other embodiments these two components may be replaced by other operatively or functionally equivalent components or may even be eliminated. For example, in one embodiment, instead of using liner 54, the functionality of the liner 54 can be achieved by providing a narrower axial bore 47 at the top of piston rod 46 so as to obtain, for example, an internal diameter of the narrower axial bore region equal to D1 while the internal diameter of the axial bore 47 on the broader portion is equal to D2 (where D1<D2). In another embodiment, the liner 54 can be integrally formed within the axial bore 47 of the piston rod 46 thus essentially achieving the desired narrower configuration at the top of the piston rod 46.

Similarly, in another embodiment, instead of using a check valve 52 (or sleeve 52A), the functionality of the valve 52 or sleeve 52A can be achieved by providing a thicker tube 50 at a bottom of tube 50 so as to obtain, for example, an internal diameter of the thicker portion of the tube 50 equal to D6. In another embodiment, the sleeve 52A can be integrally formed with the tube 50 thus essentially achieving the desired thicker configuration at the bottom of the tube 50.

Therefore, as it can be appreciated from the above paragraphs, according to one embodiment, it is provided a spike puller 40 including housing (e.g., cylinder) 42, and tube 50 disposed within the housing 42, the tube 50 being configured to supply hydraulic fluid. The spike puller 40 further includes piston rod 46 connected to piston 44. The piston rod 46 has a hollow axial bore 47. The piston 44 and the piston rod 46 are axially moveable relative to the tube 50. The spike puller 40 further includes a passage 100 communicating fluid from the tube 50 to the piston 44, the passage 100 being contained within the housing 42. The passage 100 is inside the boundary defined by an internal surface 42S of the housing 42 against which the piston 44 is configured to slide. The passage 100 is variable between a first configuration (as shown for example in FIG. 4) in which hydraulic fluid flows at a first restricted flow so as to provide a slower retraction of the piston rod and a second configuration (as shown for example in FIG. 5) in which hydraulic fluid flows at a second less restricted flow so as to provide a faster retraction of the piston rod. In one embodiment, the passage 100 is defined at least partially by a space between an external surface of the tube 50 and internal surface of the piston rod 46 and/or between an external surface of the tube 50 and internal surface of the liner 54. In one embodiment, the movement between the tube 50 and the piston rod 46 varies the size of the space so as to change the passage from the first configuration to the second configuration.

In one embodiment, a passage can include one or more pathways through which hydraulic fluid can flow. For example, in one embodiment, the passage can have one pathway. In another embodiment, the passage can include two pathways such that hydraulic fluid flows through a first pathway at a first restricted flow so as to provide a slower retraction of the piston rod and flows through a second pathway or through both the first and second pathways at a second less restricted flow so as to provide a faster retraction of the piston rod.

Therefore, as it can be appreciated, the passage can be varied, for example, by increasing a number of pathways (e.g., opening pathways) through which hydraulic fluid can flow, by increasing a size or an area of one or more pathways, or both.

Figure 6:
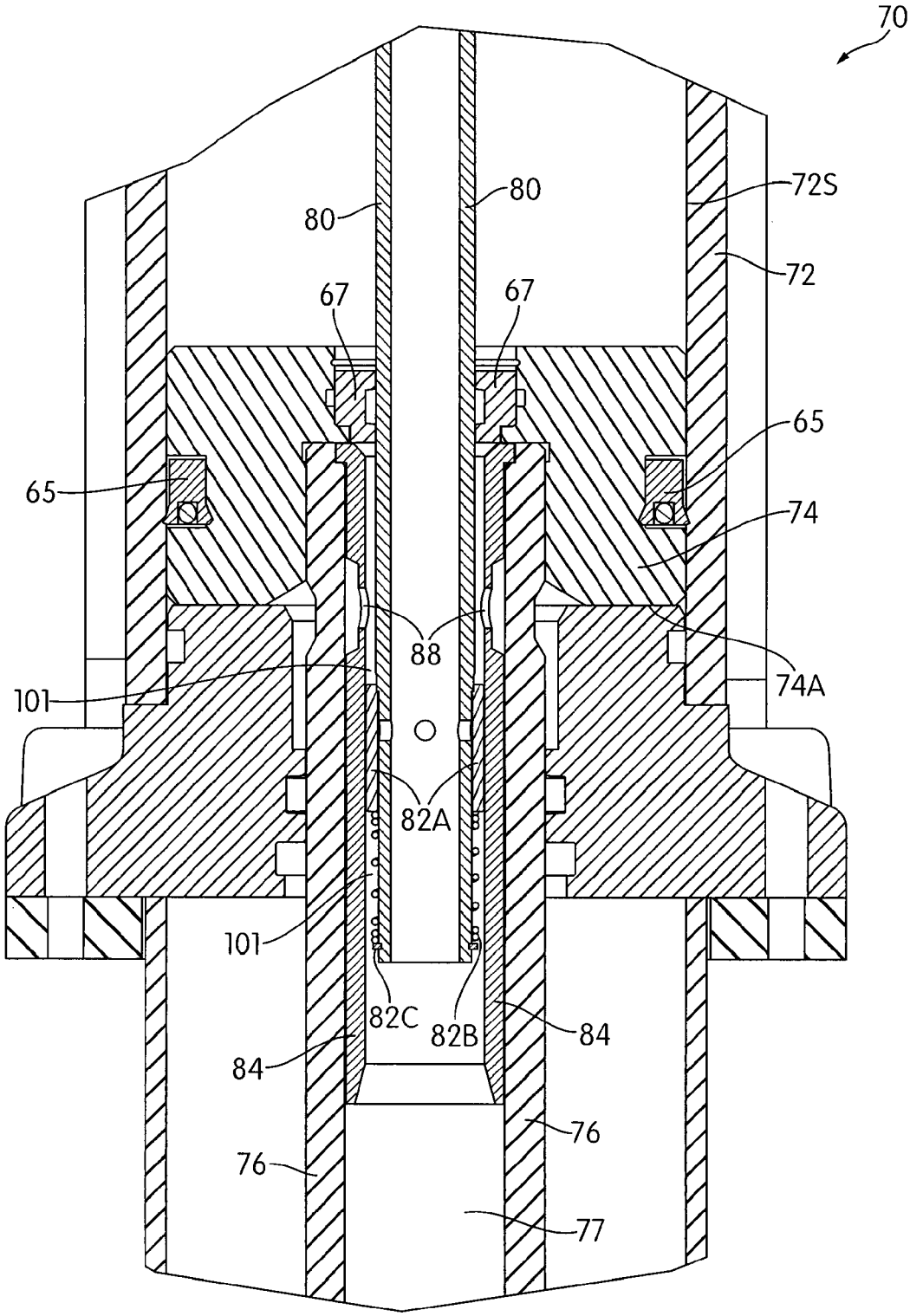
FIG. 6 is an enlarged cross-sectional view of a hydraulic spike puller, according to another embodiment of the present invention.
Figure 7A:
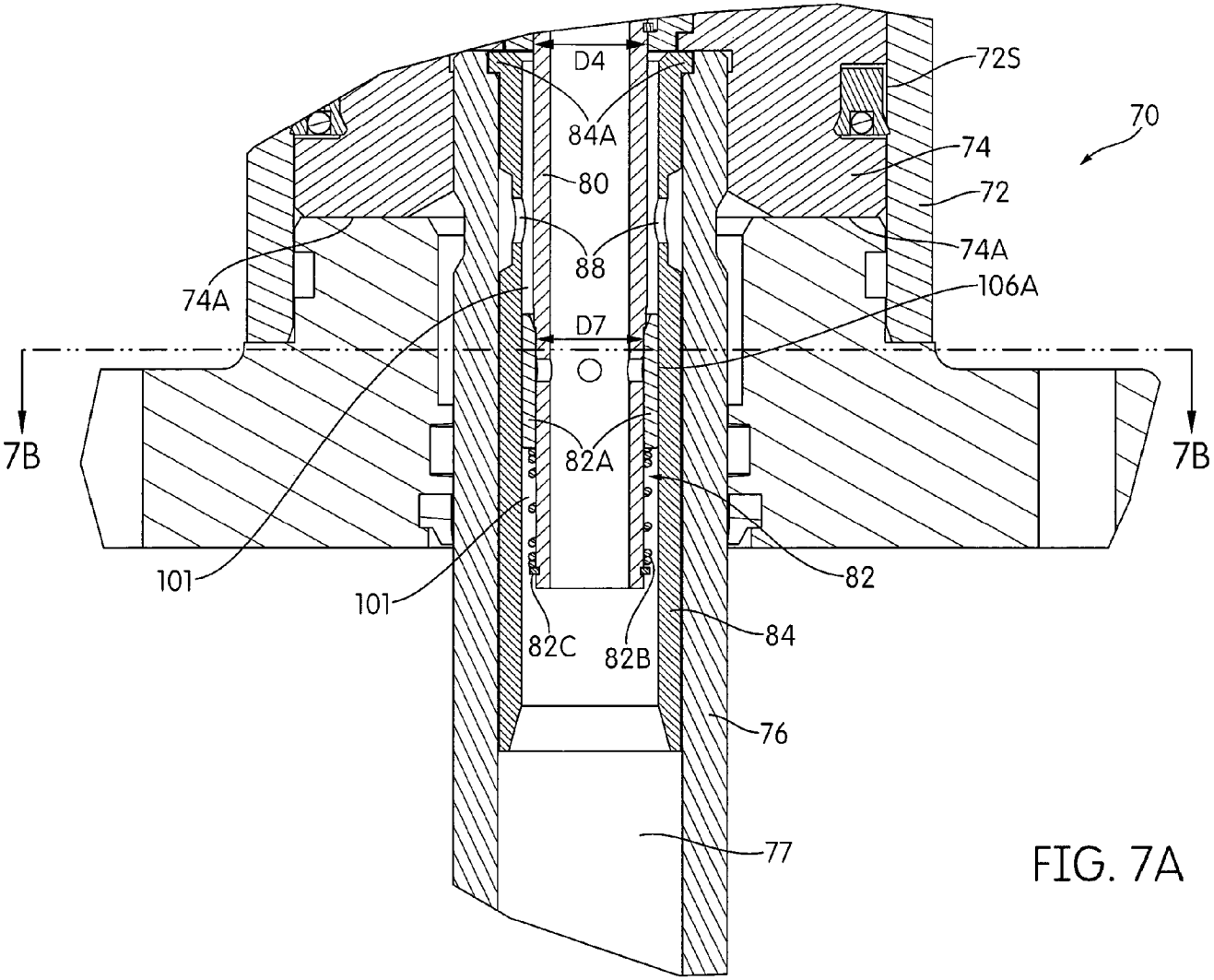
FIG. 7A is a cross-sectional view of the hydraulic spike puller shown in FIG. 6.
Figure 8A:
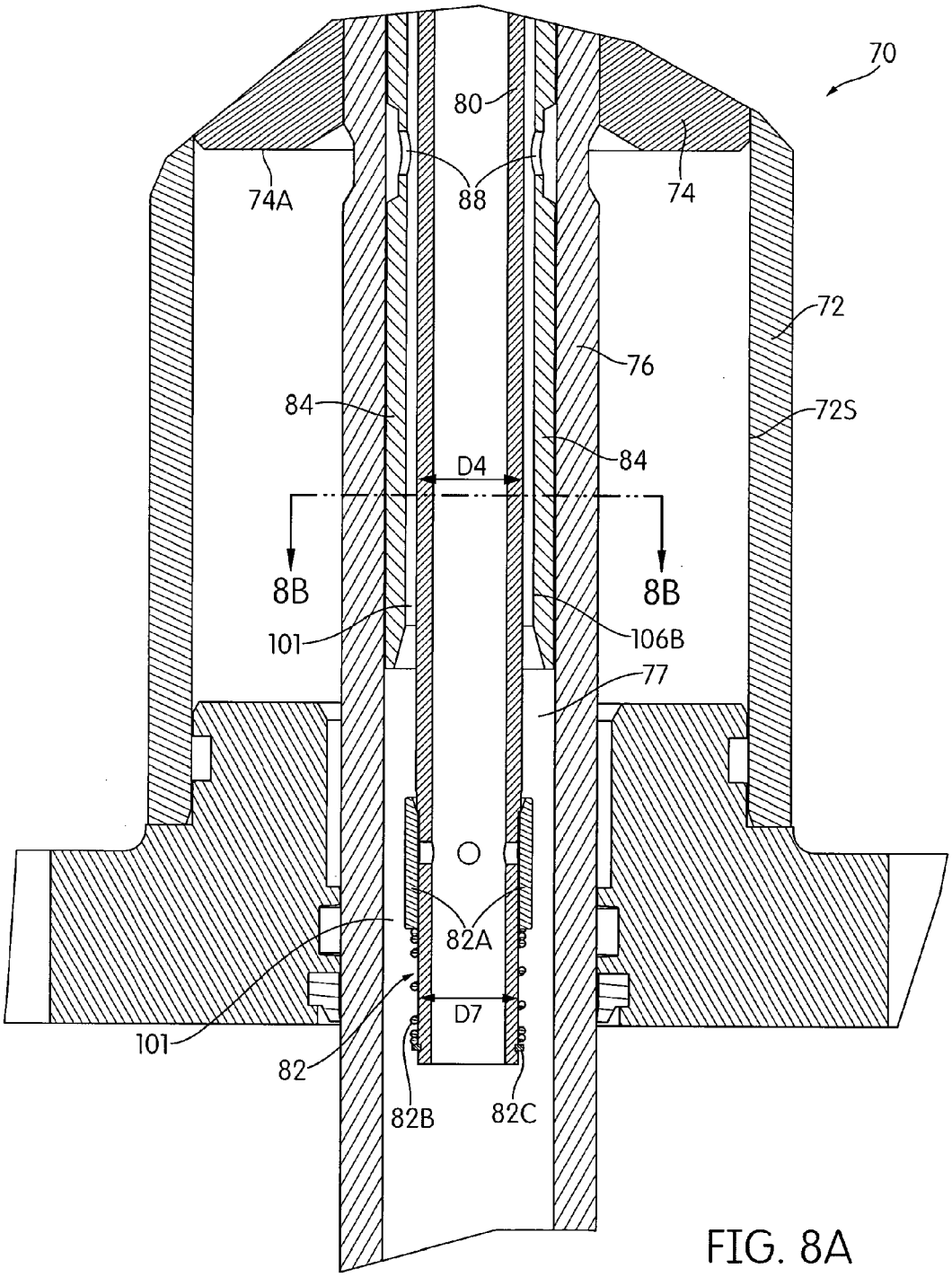
FIG. 8A is another cross-sectional view of the hydraulic spike puller shown in FIG. 6.

FIGS. 6, 7A and 8A are various cross-sectional views of a hydraulic spike puller 70, according to an embodiment of the present invention. Spike puller 70 is similar in many aspects to spike puller 40. Therefore, spike puller 70 would be described in the following paragraphs with emphasis on certain features. However, it should be appreciated that spike puller 70 may further comprise other features or functions similar to those of spike puller 40. Spike puller 70 includes a housing (e.g., cylinder) 72. Spike puller 70 also includes piston 74 configured to axially move within the cylinder 72. Fixed to piston 74 is piston rod 76. Piston rod 46 has a hollow axial bore 77 extending along most of a length of piston rod 76.

Spike puller 70 further includes fixed hollow tube 80. Fixed hollow tube 80 extends axially through piston 74 into piston rod 76. Fixed hollow tube 80 extends the length of cylinder 72 into hollow axial bore 47 of piston rod 76. The external diameter of fixed hollow tube 80 is smaller than the internal diameter of hollow axial bore 77 of piston rod 76.

As shown, for example in FIG. 6, the spike puller 70 also includes seal member 65 disposed at the periphery of piston 74 between the piston 74 and cylinder 72 and seal carrier 67 for carrying seals (not shown) disposed between piston 74 and hollow tube 80 to isolate a volume underneath the piston 74 from the volume above the piston 74.

Spike puller 70 further includes a check valve 82. Check valve 82 includes sleeve member 82A and biasing member 82B disposed around a lower end portion of fixed hollow tube 80. Biasing member 82B (for example, a spring) abuts against a ledge 82C provided at a lower end of hollow tube 80. Biasing member (for example, a spring) 82B is adapted to bias the sleeve member 52A upwardly. Spike puller 70 also includes a liner 84 disposed at an upper portion of piston rod 76 and in contact with an internal surface of hollow axial bore 77 of piston rod 76. Liner 84 has radially protruding edge 84A that is configured to fixedly connect liner 84 to piston rod 76. Liner 84 has also openings or ports 88 that are connected to openings (not shown in FIG. 7A) within piston rod 76. Although the openings within the piston rod 76 is not shown in the cross-sectional views of FIGS. 6 and 7A, this opening along with opening 88 exist to provide a path or a passage for the hydraulic fluid to reach the underside 74A of the piston 74 to lift the piston 74 during the retraction phase. The openings within piston rod 76 and openings 88 are connected so as to allow hydraulic fluid to pass from the bore 77 of piston rod 76 so as to apply pressure on underside 74A of piston 74 to actuate the piston 74. In one embodiment, the hydraulic fluid can be, for example, oil. However, other hydraulic fluid with an appropriate viscosity can also be used.

The check valve sleeve 82A forms a hydraulic fluid flow control device for hydraulic fluid moving to and from the underside 74A of the piston 74. In one embodiment, the fixed hollow tube 80, the piston rod 76, the sleeve member 82A, and the liner 84 may have a cylindrical shape. However, as it can be appreciated, in other embodiments, the fixed hollow tube 80, the piston rod 76, the sleeve member 82A, and the liner 84 may have other shapes with a polygonal transversal cross-section shape (e.g., square, hexagonal, etc.).

Figure 7B:
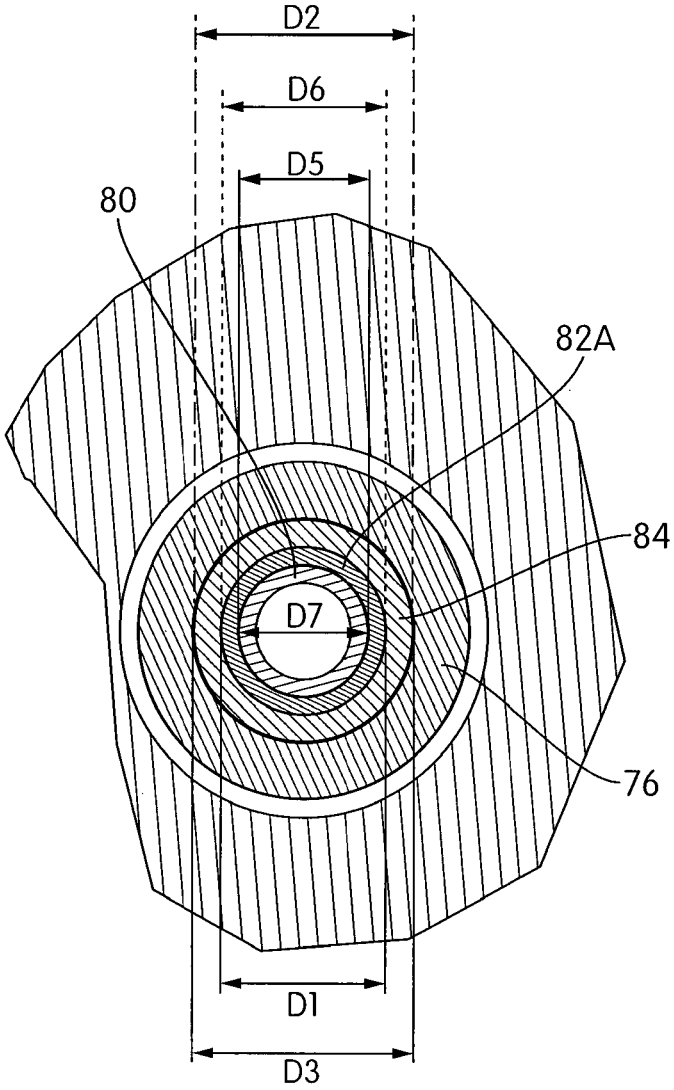
FIG. 7B is a transversal cross-sectional view along a plane BB of the view shown in FIG. 7A.
Figure 8B:
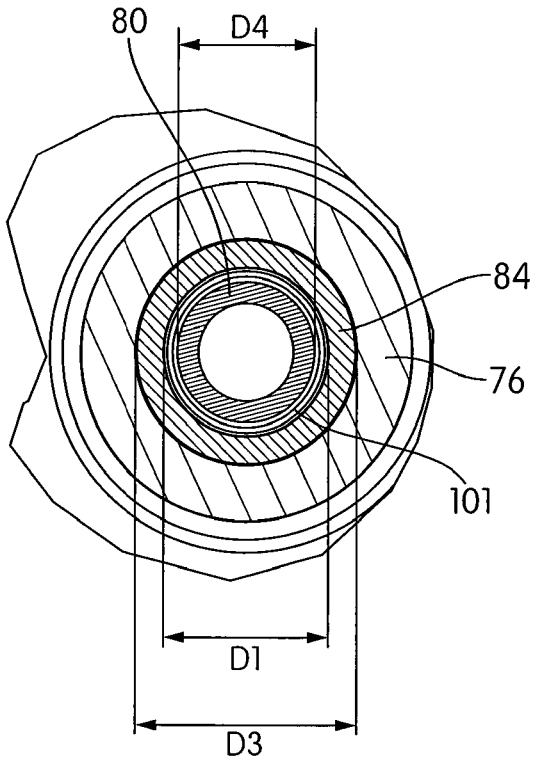
FIG. 8B is a transversal cross-sectional view along a plane CC of the view shown in FIG. 8A.

FIGS. 7B and 8B are transversal cross-sectional views of the hydraulic spike puller 70, respectively, in plane BB shown in FIG. 7A and in plane CC shown in FIG. 8A. In one embodiment, the liner 84 has an internal diameter D1 and an external diameter D3, the hollow axial bore 47 of piston rod 46 has a diameter D2. The diameter D1 is less than the diameter D2. In this embodiment, the diameter D3 is substantially equal to diameter D2. In one embodiment, the fixed hollow tube 80 has a stepped configuration and has an external diameter D4 at its thicker portion and diameter D7 at its narrower portion. However, in other embodiments, the fixed hollow tube 80 may have other configurations, such as, for example, a tapered configuration or a combination of a stepped-tapered configuration, or the like. Diameter D4 is smaller than diameter D1 and diameter D2. The sleeve member 82A has an internal diameter D5 and an external diameter D6. Diameter D5 is substantially equal to external diameter D7 of lower narrower portion of fixed hollow tube 80. Although, in FIG. 7A and FIG. 7B, the internal diameter D1 of liner 84 and external diameter D6 of sleeve member 82A appear to be equal, in fact, the diameter D6 is slightly smaller than the diameter D1.

In operation, hydraulic fluid flows through fixed hollow tube 80 and fills and pressurizes the bore 77 of piston rod 76. The hydraulic fluid then flows back through an annular space between the external surface (with external diameter D7 or D4) of fixed hollow tube 80 and the internal surface (with internal diameter D3) of piston rod 76 and through an annular space between the external surface of hollow tube 80 and internal surface of liner 84 until it moves radially outward though ports (not shown) within piston rod 76 and ports 88 within sleeve 84. As a result, the pressure and flow of the hydraulic fluid through the ports reaches the underside 74A of piston 74 and acts upon piston 74 to lift the piston 74.

FIG. 7A shows a configuration of the spike puller 70 during a first phase or reduced speed retraction of piston rod 76 of spike puller 70. FIG. 8A shows a configuration of the spike puller 70 during the second phase or full speed retraction of piston rod 76 of spike puller 70. The second phase (full speed retraction) occurs automatically after the piston 74 has moved a predetermined amount.

As shown in FIG. 7A, during the first phase (reduced speed retraction), sleeve 82A is concentric with the liner 84 and the annular space Δ1 between sleeve 82A and liner 84 is substantially equal to diameter D1 minus diameter D6 (Δ1=D1−D6). As stated above, although diameter D1 and diameter D6 appear to be equal to the naked eye, in FIG. 7A and FIG. 7B, diameter D1 is in fact slightly greater than diameter D6. In one embodiment, the difference Δ1 between diameter D1 and diameter D6 is about 0.007 inch.

As shown in FIG. 8A, after a predetermined movement of piston 74, liner 84 is pulled upward past and away from the check valve sleeve 82A. As a result, the annular passage Δ2 for hydraulic fluid becomes larger and greater than Δ1. The annular passage Δ2 is substantially equal to diameter D1 minus diameter D4 (Δ2=D1−D4). Indeed, since diameter D4 is smaller than diameter D6, annular space Δ2 is greater than annular space Δ1. A larger annular passage (Δ2>Δ1) allows a less restricted flow and thus a greater follow of hydraulic fluid which results in a faster movement of the piston 74 during the second phase of retraction.

Therefore, spike puller 70 is configured to automatically speed up in retract mode after a certain predetermined amount of piston travel. The predetermined amount of travel is controlled by the distance H between a lower edge of liner 84 and port 88 and/or controlled by the annular space between the external surface of the tube 80 and the internal surface of the liner 84. As a result, a longer distance H (i.e., a longer low portion of liner 84) and/or a thinner annular space between the external surface of the tube 80 and internal surface of liner 84 provides a longer time period for accomplishing the first slower retraction phase. Hence, the distance H and/or the annular space can be selected accordingly to tailor the first retraction phase.

In the operation of resetting the spike puller 70 and extending the piston rod 46, there is no alignment required. Therefore, resetting can be performed at a faster speed. Extending or resetting the spike puller, i.e., extending the piston rod 76, is achieved by directing hydraulic fluid flow or fluid pressure to the top of the piston 74 by using valve assembly (not shown). The speed of descent of the piston 74 is limited by the rate at which the hydraulic fluid underneath the piston 74 can be vented via hydraulic return lines (not shown).

Figure 9:
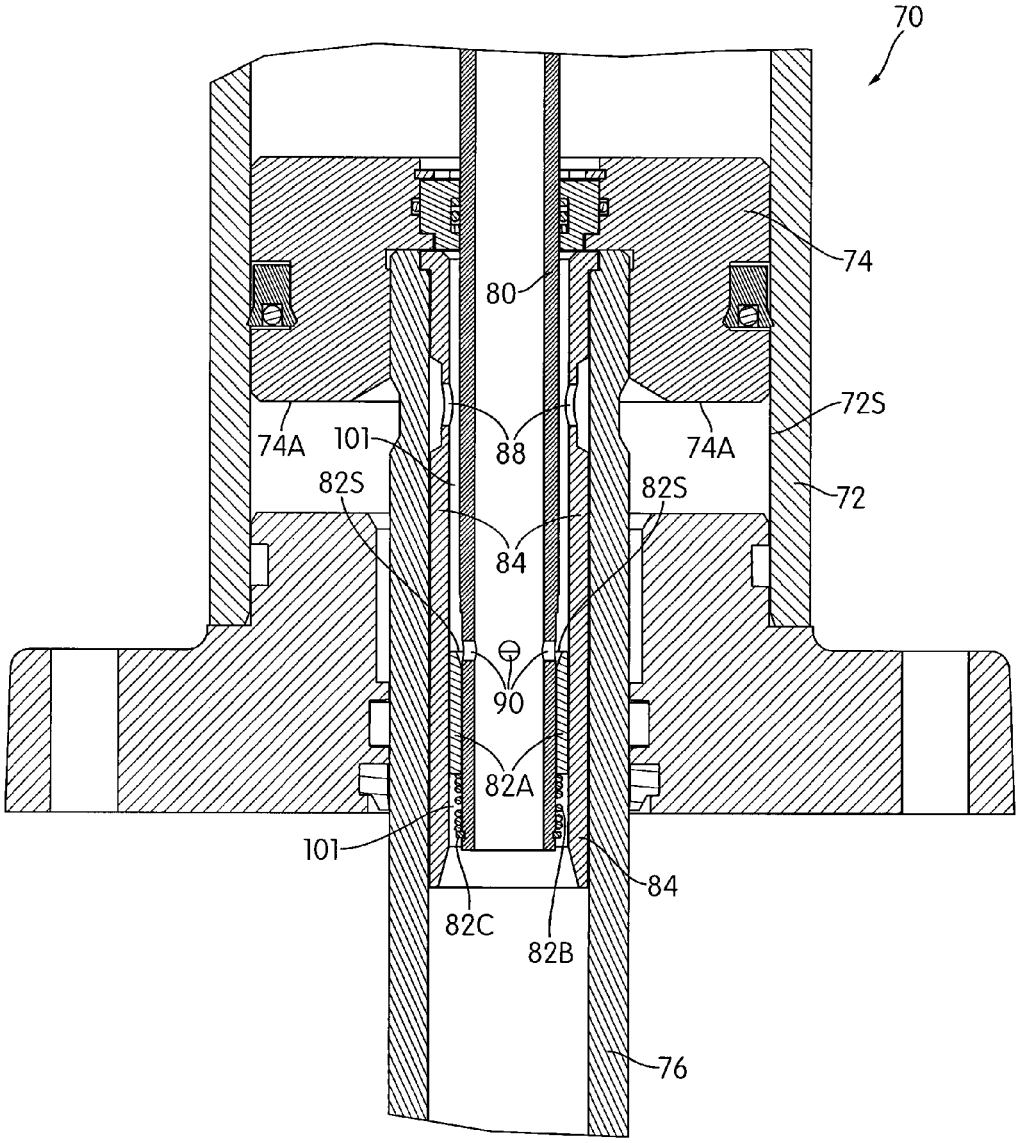
FIG. 9 is a cross-sectional view of the hydraulic spike puller shown in FIGS. 6, 7A and 8A during a resetting phase of the spike puller, according to an embodiment of the present invention.

FIG. 9 is a cross-sectional view of a hydraulic spike puller 70 during a resetting phase of the spike puller, according to an embodiment of the present invention. As shown in FIG. 9, the hydraulic fluid is vented from underneath the descending piston 74 (underneath underside 74A) by flowing backward through essentially the same path it flowed inward during the retraction phase as described above. When piston 74 is high in cylinder 72, and the check valve 82 is below the liner 84, the speed limiting annular space is Δ2, which permits a faster movement of the piston 44. As the piston 74 nears the bottom of the cylinder 72, the liner 84 slides down over the check valve 82 (or sleeve 8A). Hence, the speed limiting annular space becomes smaller and equal to Δ1 (where Δ1<Δ2). As a result, the flow of hydraulic fluid is reduced which slows the movement of the piston 74 as it descends. However, because hydraulic pressure remains applied to the top of the piston 74, there is a corresponding increase in the pressure of oil vented under the piston 74. The higher venting hydraulic pressure acts on upper annular surface 82S of sleeve 82A of check valve 82 and pushes the sleeve 82A downwardly against the biasing force of resilient member (e.g., spring) 82B and axially moves the sleeve 82A relative to the tube 80. The downward axial movement of the sleeve 82A uncovers radial ports 90, which are provided within a lower part of the tube 80, opening an additional flow pathway for the hydraulic fluid to vent from the hollow axial bore 77 of piston rod 76 into tube 80. The vented hydraulic fluid into tube 80 is then sent back to the hydraulic return. Therefore, the opening of check valve 82 allows to maintain a relatively fast descent of the piston 44 to the lower start or reset position.

Similar to the embodiment depicted in FIGS. 3, 4 and 5, spike puller 70 also includes a passage 101 communicating fluid from the tube 80 to the piston 74, the passage being contained within the housing 72. The passage is inside the boundary defined by an internal surface 72S of the housing 72 against which the piston 74 is configured to slide. The passage 101 is variable between a first configuration (as shown for example in FIG. 7A) in which hydraulic fluid flows at a first restricted flow so as to provide a slower retraction of the piston rod and a second configuration (as shown for example in FIG. 8A) in which hydraulic fluid flows at a second less restricted flow so as to provide a faster retraction of the piston rod. In one embodiment, the passage 101 is defined at least partially by a space between an external surface of the tube 80 and internal surface of the piston rod 76 and/or between an external surface of the tube 80 and internal surface of the liner 84. In one embodiment, the movement between the tube 80 and the piston rod 76 varies the size of the space so as to change the passage 101 from the first configuration to the second configuration.

Similar to the embodiment shown in FIGS. 3, 4 and 5, a passage can also include one or more pathways through which hydraulic fluid can flow. For example, in one embodiment, the passage can have one pathway. In another embodiment, the passage can include two pathways such that hydraulic fluid flows through a first pathway at a first restricted flow so as to provide a slower retraction of the piston rod and flows through a second pathway or through both the first and second pathways at a second less restricted flow so as to provide a faster retraction of the piston rod.

Therefore, as it can be appreciated, the passage can be varied, for example, by increasing a number of pathways (e.g., opening pathways) through which hydraulic fluid can flow, by increasing a size or an area of one or more pathways, or both.

As it can be appreciated from the above paragraphs, according to one embodiment, it is also provided a method of pulling a workpiece (e.g., a spike, a fastener, etc.) with a dual-stage retraction pulling tool (e.g., tool 40, 70), the pulling tool including a housing 42, 72, a piston 44, 74 and a piston rod 46, 76. The method includes flowing hydraulic fluid (for example oil) through a relatively smaller first area 105A, 106A (for example, in tool 40, 70, a space between an external surface of the tube 50, 80 and internal surface of the piston rod 46, 76 and/or between an external surface of the tube 50, 80 and internal surface of the liner 54, 84) within the housing so as to provide a slower movement of the piston and a slower retraction of the pulling tool (as shown, for example, in FIGS. 4 and 7A). The method further includes automatically changing an area through which the hydraulic fluid flows from the first area 105A, 106A to a second area 105B, 106B (for example, in tool 40, 70, a space between an external surface of the tube 50, 80 and internal surface of the piston rod 46, 76 and/or between an external surface of the tube 50, 80 and internal surface of the liner 54, 84) larger than the first area 105A, 106A (as shown, for example, in FIGS. 5 and 8A). The method also includes flowing the hydraulic fluid through the relatively larger second area 105B, 106B within the housing so as to provide a faster movement of the piston 44, 74 and a faster retraction of the pulling tool.

Although embodiments of the invention are described in the above paragraphs in relation to a spike puller, the same mechanism of dual stage speed retraction can be used in any other pulling tool including, but not limited to, a tool or device for pulling or extracting nails, staples or any other type of fasteners, or can be used to pull any workpiece.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

It should be appreciated that in one embodiment, the drawings herein are drawn to scale (e.g., in correct proportion). However, it should also be appreciated that other proportions of parts may be employed in other embodiments.

Furthermore, since numerous modifications and changes will readily occur to those of skill in the art, it is not desired to limit the invention to the exact construction and operation described herein. Accordingly, all suitable modifications and equivalents should be considered as falling within the spirit and scope of the invention.

What is claimed:

1. A pulling tool comprising:

a housing;

a tube disposed within the housing, the tube configured to supply hydraulic fluid;

a piston rod connected to a piston, the piston rod having a hollow axial bore, the piston and the piston rod being axially moveable relative to the tube; and a passage communicating fluid from the tube to the piston, the passage being contained within the housing, wherein the passage is variable between a first configuration in which hydraulic fluid flows at a first restricted flow so as to provide a slower retraction of the piston rod and a second configuration in which hydraulic fluid flows at a second less restricted flow so as to provide a faster retraction of the piston rod, and wherein the passage is inside a boundary defined by an internal surface of the housing against which the piston is configured to slide.

2. The pulling tool according to claim 1, wherein the piston rod is moveable relative to the tube from a first position to a second position, wherein in the first position hydraulic fluid flows at the first restricted flow, and in the second position, hydraulic fluid flows at the second less restricted flow.

3. The pulling tool according to claim 1, further comprising a head portion and a bottom portion capping the housing, wherein the tube is connected to the head portion.

4. The pulling tool according to claim 3, wherein the tube extends axially from the head portion through the hollow axial bore of the piston rod.

5. The pulling tool according to claim 1, further comprising a jaw assembly adapted to clamp a spike, wherein the piston rod is further connected to the jaw assembly.

6. The pulling tool according to claim 1, further comprising a check valve disposed at an end of the hydraulic tube.

7. The pulling tool according to claim 6, wherein the check valve comprises a sleeve member and a biasing member disposed around a lower portion of the hydraulic tube, the biasing member configured to bias the sleeve member upwardly.

8. The pulling tool according to claim 1, further comprising a liner disposed inside the hollow axial bore.

9. The pulling tool according to claim 8, wherein the liner is in contact with an internal surface of the hollow axial bore.

10. The pulling tool according to claim 9, wherein the liner has lateral ports aligned to allow hydraulic fluid to exit from the axial bore to actuate the piston.

11. The pulling tool according to claim 1, wherein the piston rod has lateral ports to allow hydraulic fluid to exit from the axial bore to actuate the piston.

12. The pulling tool according to claim 1, wherein the passage is defined at least partially by a space between an external surface of the tube and an internal surface of the piston rod.

13. The pulling tool according to claim 12, wherein relative movement between the tube and the piston rod varies the size of the space so as to change the passage from the first configuration to the second configuration.

14. The pulling tool according to claim 1, further comprising:

a check valve disposed at an end of the tube, the check valve comprising a sleeve member; and a liner disposed inside the hollow axial bore, wherein an internal dimension of the liner is greater than an external dimension of the sleeve member such that when the sleeve member is concentric with the liner, the sleeve member and the liner define a first annular space that is substantially equal to a difference between the internal dimension of the liner and the external dimension of the sleeve member to allow a first restricted flow of hydraulic fluid therethrough and effect a slower retraction of the piston rod.

15. The pulling tool according to claim 14, wherein an external dimension of the tube is smaller than an internal dimension of the liner such that when the liner is pulled upward past and away from the sleeve member, the hollow tube and the sleeve member define a second annular space that is substantially equal to a difference between the internal dimension of the liner and the external dimension of the tube to allow a second less restricted flow of hydraulic fluid therethrough to effect a faster retraction of the piston rod.

16. The pulling tool according to claim 15, wherein the pulling tool is configured to automatically change a speed of retraction of the piston rod after a certain predetermined amount of piston travel.

17. The pulling tool according to claim 16, wherein the predetermined amount of piston travel is controlled by a distance between a lower edge of the liner and a port within the liner for communicating fluid to the piston, or controlled by a size of the second annular space, or both.

18. A pulling tool comprising:

a housing;

a tube disposed within the housing, the tube configured to supply hydraulic fluid;

a piston rod connected to a piston, the piston rod having a hollow axial bore, the piston and the piston rod being axially moveable relative to the tube;

a passage communicating fluid from the tube to the piston, the passage being contained within the housing, wherein the passage is variable between a first configuration in which hydraulic fluid flows at a first restricted flow so as to provide a slower retraction of the piston rod and a second configuration in which hydraulic fluid flows at a second less restricted flow so as to provide a faster retraction of the piston rod; and a head portion and a bottom portion capping the housing, wherein the tube is connected to the head portion.

19. The pulling tool according to claim 18, wherein the tube extends axially from the head portion through the hollow axial bore of the piston rod.

20. The pulling tool according to claim 18, wherein the piston rod is moveable relative to the tube from a first position to a second position, wherein in the first position hydraulic fluid flows at the first restricted flow, and in the second position, hydraulic fluid flows at the second less restricted flow.

21. The pulling tool according to claim 18, further comprising a check valve disposed at an end of the hydraulic tube.

22. The pulling tool according to claim 21, wherein the check valve comprises a sleeve member and a biasing member disposed around a lower portion of the hydraulic tube, the biasing member configured to bias the sleeve member upwardly.

23. The pulling tool according to claim 18, further comprising a liner disposed inside the hollow axial bore.

24. The pulling tool according to claim 23, wherein the liner is in contact with an internal surface of the hollow axial bore.

25. The pulling tool according to claim 24, wherein the liner has lateral ports aligned to allow hydraulic fluid to exit from the axial bore to actuate the piston.

26. The pulling tool according to claim 18, wherein the piston rod has lateral ports to allow hydraulic fluid to exit from the axial bore to actuate the piston.

27. The pulling tool according to claim 18, wherein the passage is defined at least partially by a space between an external surface of the tube an internal surface of the piston rod.

28. The pulling tool according to claim 27, wherein relative movement between the tube and the piston rod varies the size of the space so as to change the passage from the first configuration to the second configuration.

29. The pulling tool according to claim 18, further comprising:

a check valve disposed at an end of the tube, the check valve comprising a sleeve member; and a liner disposed inside the hollow axial bore, wherein an internal dimension of the liner is greater than an external dimension of the sleeve member such that when the sleeve member is concentric with the liner, the sleeve member and the liner define a first annular space that is substantially equal to a difference between the internal dimension of the liner and the external dimension of the sleeve member to allow a first restricted flow of hydraulic fluid therethrough and effect a slower retraction of the piston rod.

30. The pulling tool according to claim 29, wherein an external dimension of the tube is smaller than an internal dimension of the liner such that when the liner is pulled upward past and away from the sleeve member, the hollow tube and the sleeve member define a second annular space that is substantially equal to a difference between the internal dimension of the liner and the external dimension of the tube to allow a second less restricted flow of hydraulic fluid therethrough to effect a faster retraction of the piston rod.

31. The pulling tool according to claim 30, wherein the pulling tool is configured to automatically change a speed of retraction of the piston rod after a certain predetermined amount of piston travel.

32. The pulling tool according to claim 31, wherein the predetermined amount of piston travel is controlled by a distance between a lower edge of the liner and a port within the liner for communicating fluid to the piston, or controlled by a size of the second annular space, or both.

33. The pulling tool according to claim 28, further comprising a jaw assembly connected to the piston rod, wherein the jaw assembly is configured to clamp a spike.

* * * * *